United States Patent [19]

Thomas et al.

[11] 4,077,586

[45] Mar. 7, 1978

[54] DROP WIRE PAYOUT APPARATUS

[75] Inventors: Robert M. Thomas, Florham Park; John R. Reiser, Piscataway, both of N.J.

[73] Assignee: General Cable Corporation, Greenwich, Conn.

[21] Appl. No.: 690,015

[22] Filed: May 26, 1976

[51] Int. Cl.[2] ..... B65H 49/00; B65H 49/18; D01H 7/16

[52] U.S. Cl. ..... 242/129.5; 242/137.1

[58] Field of Search ..... 242/129, 129.5, 137, 242/137.1, 138, 118.6–118.8; 206/389, 390, 397; 225/46, 47, 66; 229/14 R, 14 B, 14 BL, DIG. 14

[56] References Cited

U.S. PATENT DOCUMENTS

| | | | |
|---|---|---|---|
| 2,578,244 | 12/1951 | Harrison | 229/7 R |
| 2,758,773 | 8/1956 | Gibbons | 229/15 |
| 2,799,458 | 7/1957 | Nye | 242/118.8 |
| 2,822,992 | 2/1958 | Moulden | 242/137.1 |
| 2,991,958 | 7/1961 | Eifrid | 242/137.1 |
| 3,502,284 | 3/1970 | Loewenberg et al. | 242/199 |
| 3,751,043 | 8/1973 | Bracci | 242/199 |
| 3,876,073 | 4/1975 | Herbetko | 206/400 |

*Primary Examiner*—Leonard D. Christian
*Attorney, Agent, or Firm*—Roy C. Hopgood; John M. Calimafde; Charles W. Neill

[57] ABSTRACT

This specification discloses simplified wire payout apparatus for paying out wire directly from a box in which the wire is shipped, thus eliminating the necessity of providing mechanical payout equipment such as has been required on utility service trucks. For light-weight and low cost, a corrugated paperboard carton is used as a shipping container; and provision is made for paying out the wire without removing a spool, on which the wire is wound, from the box. The spool is preferably also made of corrugated paperboard.

8 Claims, 8 Drawing Figures

DROP WIRE PAYOUT APPARATUS

BACKGROUND AND SUMMARY OF THE INVENTION

Utility service trucks, particularly those used for telephones, carry quantities of wire which are coiled on spools and payed out in the lengths required by mechanical payoff equipment. The spools generally carry a large quantity of wire and are heavy; and the payoff equipment is also heavy.

In order to reduce the size and operating cost of service trucks, this invention provides means for supplying the necessary wire from smaller and inexpensive spools from which the wire can be payed out without removing the spool from its shipping carton and without having any payout equipment, such as has to be used with heavy spools.

This invention provides a spool which can be constructed from corrugated paperboard by a novel arrangement of parts; and the spool is shipped in a special carton, which can also be made of corrugated paperboard, and which has provision for convenient payout of the wire without removing the spool from the carton.

Features of the invention include the special construction of the spool and carton; provision for holding the end of the wire for convenient handling and, at the same time, adequate sealing against tampering before the carton is opened for use; low friction of the spool as it rotates in the carton during payout of wire; convenient rewinding of wire on the spool of any excess wire payed out from the carton; and inspection openings through which the amount of wire remaining on the spool as the spool rotates while the wire is paying out, can be determined.

Other objects, features and advantages of the invention will be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 3:
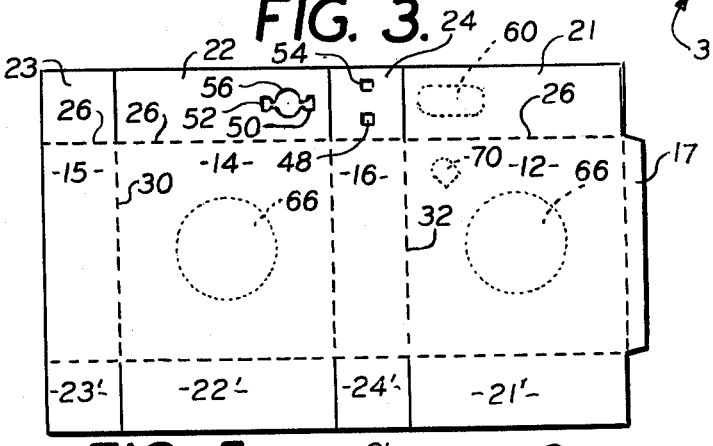
FIG. 3 is a greatly reduced scale view showing the blank from which the carton of FIG. 1 is made by folding the various panels along predetermined fold lines.
Figure 4:
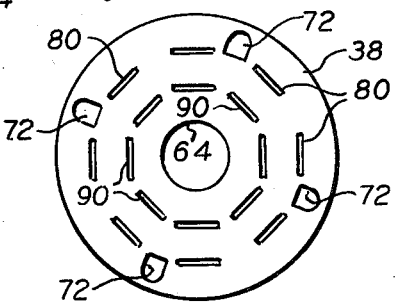
FIG. 4 is a reduced scale view showing one of the flanges of the spool of FIGS. 1 and 2 before the spool is assembled.
Figure 5:
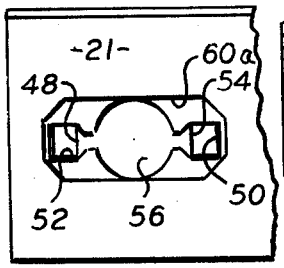
FIG. 5 is a fragmentary plan view of the top of the carton shown in FIG. 1 and illustrating the openings through which wire is withdrawn from the carton.

A container or box 10 includes a front wall 12 and a back wall 14 connected to one another by side panels 15 and 16. The box is preferably made from a single blank, as shown in FIG. 3.

The left-hand edge of the side panel 15 is secured to the right-hand edge of the front wall 12 by a flap 17 and suitable adhesive. There are end panels 21, 22, 23 and 24 attached to the walls 12 and 14 and panels 15 and 16, respectively, along fold lines designated by the dotted line 26 in FIG. 3. There are similar end panels at the other end of the box indicated by the same reference characters but with a prime appended. These panels at the bottom of the box are similar to those at the top, except that certain openings are provided in the top panels for removal of wire from the box.

The flap 17 is secured to the panel 15, and the box is folded flat along fold lines 30 and 32. When the box is to be set up, preparatory to receiving a spool of wire, the folded blank is opened up so that the front and back walls 12 and 14 extend at right angles to the panels 15 and 16; and the end panels are then folded inward with the panels at the top and bottom of the box overlapping others at the same end of the box to produce the container shown in FIG. 1.

Figure 1:
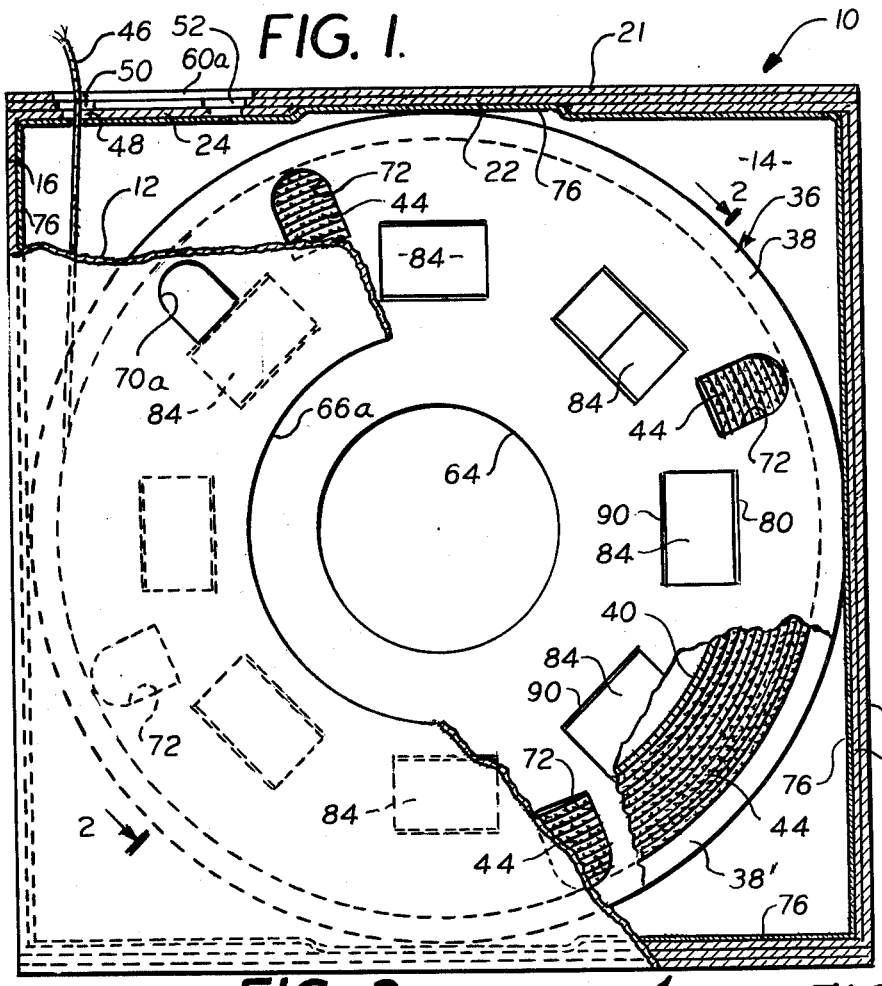
FIG. 1 is a side view, partly broken away and in section, of a carton and wire spool made in accordance with this invention.

The bottom panels 21', 22', 23' and 24' are secured together with adhesive over areas sufficient to provide a strong and permanent bottom for the box; this bottom being indicated by the reference character 34 in FIG. 1.

The upper panels 21, 22, 23, and 24 are not secured together until after the box is filled. A spool 36, having flanges 38 and a core 40 connecting the flanges is inserted into the box 10 with the upper panels 21–24 extending upward. The spool 36 is of a size which fits loosely within the box 10 so that the spool is free to rotate in the box with no substantial pressure against the sides of the box, except such pressure as is exerted by the weight of the spool and its contents against an underlying side of the box; the particular side depending upon which way the box is oriented when being used to supply wire.

A coil of wire 44 is wound on the core 40 between the flanges 38 in the conventional manner. The outer end portion of the wire 44, which is designated in the drawing by the reference character 46, is led out through an opening 48 before the panel 24 is folded down into the position which it will occupy when the box is closed. The end portion 46 is then led through an opening 50 as the panel 26 is folded down into closed position. The portion 46 of the wire is then bent horizontally and the end of the wire inserted back into the box 10 through an opening 52 in the panel 22 and through an opening 54 in the panel 24, as shown in FIG. 6.

The upper panel 21 is then folded down to complete the closing of the box, and the various panels forming the top of the box are secured together with adhesive, or otherwise, with sufficient strength to provide a top structure which is an integral unit of the box.

Figure 6:
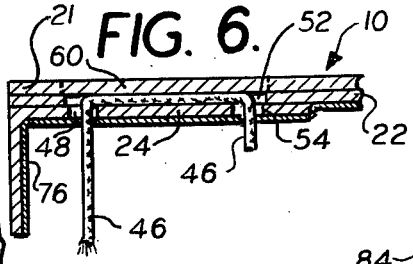
FIG. 6 is a sectional view on the line 6—6 of FIG. 5 but showing the top opening closed by a knockout.

The upper panel 22 is cut away between the openings 50 and 52 to provide a clearance 56 for the end portion of the wire, as also shown in FIG. 6. This clearance 56 is made with a wider part between the openings 50 and 52 so that a workman can insert his thumb and forefinger into the clearance 56, on opposite sides of the wire, to pull the wire upward and bring the end of the wire out of the openings 52 and 54 when more wire is to be pulled out of the box.

The upper panel 21 has a knockout 60 where the panel is cut part way through or cut enough to weaken it so that the knockout 60 can be removed to expose the openings 50 and 52 and the other openings in alignment with these openings 50 and 52. The knockout 60 seals the box during shipment and as long as the knockout is in place, anyone receiving the box in shipment is assured that the wire has not been tampered with or any of it withdrawn from the carton prior to delivery of the carton at its ultimate destination.

The spool has two flanges; the nearer flange in FIG. 1 being designated by the reference character 38 and the distant flange by the reference character 38'. Both of the flanges are of similar construction, and each one has a center opening 64 which is large enough to enable a workman to insert his hand into the interior of the spool and grip the circumferential edge of the opening 64 so as to rotate the flange manually, as necessary, and the spool must be rotated in order to wind the wire back into the box. In order to provide access to the edge of the opening 64, there is a knockout 66 in each of the front and back walls 12 and 14. Removal of a knockout 66 leaves an opening **66*a*, as shown for the front wall 12 in FIG. 1. The opening 66*a* is substantially larger in diameter than the opening 64** of the flange so as to provide exposure of an outside surface of the flange which can be gripped by a workman to rotate the spool when winding wire back on the spool.

There is another knockout 70 in the front wall 12, and when this knockout 70 is removed it leaves an inspection opening **70*a* which has a radial extent equal to the radial thickness of the wire 44 on the spool 36 when the spool is full of wire. There are openings 72 at angularly spaced locations around the flange 38. These openings 72 are preferably of the same size as the opening 70*a*, and they are located in positions that are in alignment with the opening 70*a* whenever one of the openings 72 passes under the opening 70*a* as the spool 36 rotates in the box. The openings 72 extend completely through the flange 38 and thus expose the wire 44 to view, so that anyone using the wire from the spool 36 can see how much wire is left on the spool as each of the successive openings 72 passes under the inspection opening 70*a***.

The spool 36, which fits loosely in the box 10, rotates in the box and has relative movement with respect to any inside surface of the box in which it contacts from time to time. In order to reduce friction and to make it easier to withdraw wire from the spool, means are preferably provided for reducing the friction between the spool and the surfaces of the box. This is done economically by lining the box with wax paper 76 or by coating the blank from which the box is made with wax applied to the surfaces which will constitute the inside of the box when the blank is folded to complete the box.

Figure 2:
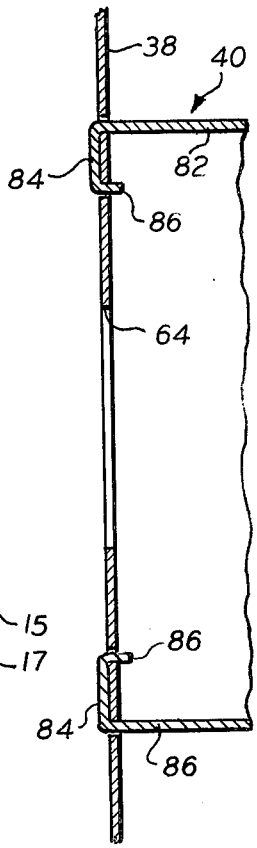
FIG. 2 is a fragmentary sectional view taken on the line 2—2 of FIG. 1.

Each of the flanges 38 is made with angularly located slots 80. The core 40 is formed with a continuous panel 82 which is long enough to form the circumference of the core. There are projections 84 extending from opposite edges of the panel 82, and these projections 84 are of a size to insert into the slots 80. The projections 84 are then bent inwardly toward the axis of the spool 36, and end portions 86 of the projections 84 are tucked into other slots 90, which are radially spaced from the slots 80. This construction is best shown in FIG. 2. To facilitate the neat bending and tucking in of the projections 84, there are weakened lines 92 formed in each projection at the time that the core blank is manufactured by die-cutting it from a panel of corrugated paperboard when the spool is made of such material.

Figure 7:
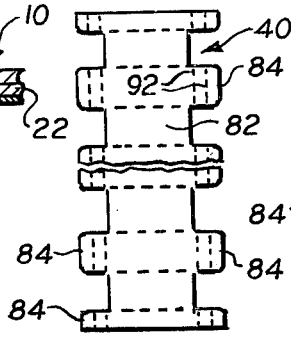
FIG. 7 is a fragmentary, reduced scale view of the core of the spool before the spool is assembled.
Figure 8:
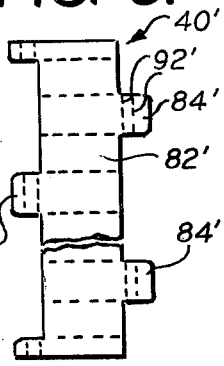
FIG. 8 is a view similar to FIG. 7 but showing a modified construction for the core.

FIG. 8 shows a construction of a core blank which is similar to FIG. 7 but made with projections 84' which are spaced further apart, so that there is a projection 84' for every other slot 84. The projections 84' on one side of a panel 82' are in staggered relation with similar projections 84' on the other end of the core. This reduces the labor involved in connecting the flanges to the core when assembling a spool, but at some sacrifice in the strength of the spool.

The spool and its shipping container can be made of other material than that described above for the preferrred embodiment, and other changes and modifications can be made, and some features can be used in different combinations without departing from the invention as defined in the claims.

What is claimed is:

1. Wire payout apparatus including in combination a box, a spool for wire, the spool having flanges and being of a size to fit loosely in the box with the flanges adjacent to inside surfaces of the box, an end of the box having an opening therein through which wire can be pulled from the box in a direction tangent to a reel of wire wrapped on the spool, the spool being supported from an underlying portion of the box and rotating with respect thereto, as wire is pulled from the spool when the box is in position for paying out wire, characterized by the spool being supported only by contact of a flange of the spool with an underlying portion of the box on which said flange seats, said box being a throw-away shipping container for the spool of wire, and means located between the spool and the supporting portion of the box for reducing friction below that which would oppose rotation of the spool if the spool were in direct contact with the portion of the box under the spool.

2. The wire payout apparatus described in claim 1 characterized by said means including a coating of wax which serves as a lubricant.

3. The wire payout apparatus described in claim 1 characterized by a lining of wax paper in the box for reducing friction of the spool as the spool rotates with respect to an underlying side of the box.

4. The wire payout apparatus described in claim 1 characterized by the box being a folding carton made of corrugated paperboard, and the opening through which the wire is pulled from the carton being in one end of the carton with means for closing and sealing said opening during shipment of the carton with the spool of wire enclosed therein.

5. Wire payout apparatus including in combination a box, a spool for wire, the spool having flanges and being of a size to fit loosely in the box with the flanges adjacent to inside surfaces of the box, an end of the box having an opening therein through which wire can be pulled from the box in a direction tangent to a reel of wire wrapped on the spool, the spool being supported from an underlying portion of the box and rotating with respect thereto, as wire is pulled from the spool when the box is in position for paying out wire, characterized by the box being a folding carton made of corrugated paperboard, and the opening through which the wire is pulled from the carton being in one end of the carton with means for closing and sealing said opening during shipment of the carton with the spool of wire enclosed therein, and further characterized by the opening through which the wire is pulled being at an end of the box that prevents the flange from being pulled out of the box during payout of the wire, said end of the box comprising three overlapping panels, including an inner panel with two spaced-apart openings therethrough, one for passage of wire out of the box through the inner panel, and the other for receiving the end of the wire which is pushed back through the second opening into the box between successive payouts of wire, the second panel having an opening therethrough that spans the openings in the first panel and the space between them, the opening in the second panel being wide enough along part of its length to provide space for a thumb and forefinger of a hand for convenient gripping of the wire spanning the openings in the first panel, and a knockout opening in the third panel overlying the openings in the other panels but sealing the box from tampering when the box is in shipment, the knockout providing access to the wire when the material of the knockout is removed prior to putting the box into use as a wire payout apparatus.

6. Wire payout apparatus including in combination a box, a spool for wire, the spool having flanges and being of a size to fit loosely in the box with the flanges adjacent to inside surfaces of the box, an end of the box having an opening therein through which wire can be pulled from the box in a direction tangent to a reel of wire wrapped on the spool, the spool being supported from an underlying portion of the box and rotating with respect thereto, as wire is pulled from the spool when the box is in position for paying out wire, characterized by the spool having openings through the flanges in position to expose the side of the coil of wire wound on the spool so that the amount of wire remaining on the spool at any time can be estimated, an inspection opening through a side of the box in a position that the openings in the spool flange pass under as the spool rotates in the box during payout of wire from the spool, the sides of the box enclosing a chamber that is correlated with the diameter of the spool flanges to limit movement of the spool transversely of its axis to a range that causes the openings of the flange to always pass under said opening in the side of the box.

7. The wire payout apparatus described in claim 1 characterized by the box being a corrugated paperboard folding carton, and the inspection opening through the side of the box being closed by a knockout in the corrugated board to prevent access to the wire during shipment, material of the knockout being removable to leave the inspection opening unobstructed when the carton is put into use at a payout apparatus.

8. Wire payout apparatus including in combination a box, a spool for wire, the spool having a hollow core on which the wire is wound and having flanges and being of a size to fit loosely in the box with the flanges adjacent to inside surfaces of the box, an end of the box having an opening therein through which wire can be pulled from the box in a direction tangent to a reel of wire wrapped on the spool, the spool being supported from an underlying portion of the box and rotating with respect thereto, as wire is pulled from the spool when the box is in position for paying out wire, characterized by one of the flanges having a center opening therein, substantially smaller in diameter than the hollow core, a side of the box generally parallel to and overlying the flange of the spool that has said center opening therein, a knockout in said side of the box and concentric with the spool flange, said center opening in the flange being of a size to admit a workman's hand into said hollow core, and the knockout being of a diameter substantially larger than that of the flange opening so that the opening in the side of the box formed by removal of the knockout exposes a continuous annular edge around the flange opening comprising the border of an annular area of sufficient radial width to be gripped by the workman's hand at any part of the continuous edge thereof for manual rotation of the spool to pull back any excess wire that was paid out from the spool.

* * * * *